US007780583B2

(12) United States Patent
Brown

(10) Patent No.: US 7,780,583 B2
(45) Date of Patent: Aug. 24, 2010

(54) AERO HYDRAULIC EXERCISE AND PHYSICAL THERAPY EQUIPMENT AND METHOD

(75) Inventor: Louis S. Brown, Pensacola, FL (US)

(73) Assignee: Brown & Company of Pensacola, Inc., Pensacola, FL (US)

( * ) Notice: Subject to any disclaimer, the term of this patent is extended or adjusted under 35 U.S.C. 154(b) by 62 days.

(21) Appl. No.: 12/511,312

(22) Filed: Jul. 29, 2009

(65) Prior Publication Data

US 2009/0286659 A1 Nov. 19, 2009

Related U.S. Application Data

(63) Continuation-in-part of application No. 11/359,942, filed on Feb. 22, 2006, now abandoned.

(51) Int. Cl.
*A63B 21/008* (2006.01)

(52) U.S. Cl. ..... 482/112

(58) Field of Classification Search ..... 482/111–113; 601/23; *A63B 21/008*
See application file for complete search history.

(56) References Cited

U.S. PATENT DOCUMENTS

| | | | |
|---|---|---|---|
| 445,726 | A | 2/1891 | Coop |
| 457,602 | A | 8/1891 | Coop |
| 3,531,112 | A | 9/1970 | Gibbs |
| 3,587,319 | A | 6/1971 | Andrews |
| 3,802,781 | A | 4/1974 | Good, Jr. |
| 3,911,907 | A | 10/1975 | Smith, Jr. |
| 4,129,297 | A | 12/1978 | Dolan |
| 4,191,370 | A | 3/1980 | Meyer et al. |
| 4,397,462 | A | 8/1983 | Wilmarth |
| 4,406,454 | A | 9/1983 | Dean |
| 4,471,957 | A | 9/1984 | Engalitcheff, Jr. |
| 4,575,076 | A | 3/1986 | Reichert et al. |
| 4,684,125 | A | 8/1987 | Lantz |
| 4,805,900 | A | 2/1989 | Sapp |
| 4,880,230 | A | 11/1989 | Cook |
| 4,883,268 | A | 11/1989 | Salkind |
| 4,934,695 | A | 6/1990 | Wolff |
| 4,969,643 | A | 11/1990 | Kroeker et al. |
| 5,002,272 | A | 3/1991 | Hofmeister |
| 5,037,088 | A | 8/1991 | Bernstein |
| 5,114,389 | A | 5/1992 | Brentham |
| 5,246,410 | A | 9/1993 | Fun |
| 5,284,461 | A | 2/1994 | Wilkinson et al. |
| 5,346,444 | A | 9/1994 | Hsieh |

(Continued)

*Primary Examiner*—Loan Thanh
*Assistant Examiner*—Oren Ginsberg
(74) *Attorney, Agent, or Firm*—Dennis G. LaPointe

(57) ABSTRACT

An air spring is used as a resistance device in exercise equipment having a lever arm for exercising various muscle groups such as those in arms and legs. In one embodiment, the equipment can be used while standing and the resistance movements strengthen core muscles. In another, it can be adapted to be used on a table surface for exercising hands, wrists and forearms. In still another embodiment, it can incorporate a bike pedal assembly to simultaneously aerobically exercise the legs and arms. The equipment includes resistance level regulating components and a visual indicator using a gauge or similar device to monitor resistance levels. Embodiments also include interchangeability of human interface members and a hand pump integrated with the lever arm, which may also include interchangeability of the human interface members.

5 Claims, 18 Drawing Sheets

U.S. PATENT DOCUMENTS 5,441,466 A 8/1995 Piaget et al.
5,527,251 A 6/1996 Davis
5,545,111 A 8/1996 Wang et al.
5,605,524 A 2/1997 Husted
5,632,711 A 5/1997 Hwang
5,702,327 A 12/1997 Fulbright
5,762,587 A 6/1998 Dalebout et al.
5,785,635 A * 7/1998 Gerschefske et al. ..... 482/133
5,788,617 A 8/1998 Paris
5,807,210 A 9/1998 Devlin
5,842,958 A 12/1998 Rufa
5,921,899 A * 7/1999 Rose ..... 482/112
5,947,873 A 9/1999 Sands et al.
6,705,975 B2 3/2004 Kuo
7,160,229 B2 1/2007 Park
2008/0161733 A1 * 7/2008 Einav et al. ..... 601/34

* cited by examiner

AERO HYDRAULIC EXERCISE AND PHYSICAL THERAPY EQUIPMENT AND METHOD

RELATED APPLICATION

This application is a continuation-in-part application of U.S. patent application Ser. No. 11/359,942 filed Feb. 22, 2006.

FIELD OF THE INVENTION

The present invention is directed to a method and apparatus for physical exercise using air spring technology.

BACKGROUND OF THE INVENTION

Exercise equipment, in general, is known in the art. Air springs are also known in the art. An air spring is an elastomeric bellows having end closures that allow for mounting on vehicles and industrial equipment. The bellows contains a fluid such as air, some other gas or a liquid, usually under pressure.

BRIEF SUMMARY OF THE INVENTION

The present invention is directed to physical therapy equipment based upon an air spring acting as a flexure joint, and methods of exercise utilizing the air spring. Using such a flexure joint will allow deflections in the range of nearly 90 degrees and a rotational deflection direction of a full 360 degrees.

The present invention provides for a combination of a human interface member, a lever arm and a flexure joint assembly that is configured to provide ergonomically resistive non-striking therapy for a desired body part, where the human interface member is configured to be in continuous communication for a prescribed exercise time with the body part using variable speed resistance movements over an associated range of motion such that muscles of the body part being exercised contract and lengthen due to the continuous communication with the human interface member and due to the force being applied to the human interface member with both concentric and eccentric contraction muscle training.

In one embodiment the exercise device is constructed from an air spring or referred to herein as a flexure joint device, a lever arm attached to an upper portion of the flexure joint device, a rigid unsprung frame member attached to a portion of the outer surface (lower side) of the flexure joint device to prevent motion of the portion of the flexure joint device attached to the rigid member when the lever arm is moved, and a human body engaging member attached to the lever arm, whereby the lever arm can be moved with resistance by the human body engaging member in any direction away from an in rest position of the lever arm. The resistance is adjustable and can be selectively controlled by the user by adjusting the pressure within the flexure joint device.

Air springs or flexure joint devices suitable for use in this invention are commercially available from Companies such as the Firestone Industrial Products Company. This company calls such devices AIRSTROKE® actuators and AIR-MOUNT® isolators. Although such devices are adapted to be used in pneumatic systems, they can be adapted to be used in hydraulic and aero-hydraulic systems. The elastomeric bladder is typically sandwiched between an upper and lower covers, which make the elastomeric bellows or bladder air-tight. These covers are sometimes called by the industry bead plates. The industry also provides air springs with bead rings. This design will allow design flexibility with custom mounting plates. They can be designed with flanges as means for mounting to brackets or solid surfaces. In the present invention, it is anticipated that the air springs assembly be adapted with means to attach its bottom to a solid platform, floor or other surface such as a table (rigid unsprung frame member described above); and the upper part be adapted with means for engaging a lever arm as described above. Typically, the upper part includes an inlet port for the air or hydraulic fluid medium.

The human body engaging member can be a hand grip, a foot-engaging member, such as a foot pad or any other body engaging member. The hand grip can be a T-bar configuration or cross-shaped along the lever arm containing two hand grips. The body-engaging member can be secured/strapped to work out specific body parts and allow work-out while pushing or pulling against the air spring assembly.

The human body-engaging member can be resilient or gyroscopic. The gyroscopic hand or foot feature interfaces to reduce strain and transmit force with natural body movements.

The exercise device preferably contains pressure-regulating means for adjusting pressure in the flexure joint device. This is usually done by those skilled in the art by the use of a regulating valve and relief valve. The fluid medium filling the flexure joint device can be air for pneumatic control or hydraulic fluid for hydraulic control or other similar fluid media suitable for using under pressure and suitable for varying by the use of regulators/valves, including the combination of air and hydraulic components/features.

The base member of the flexure joint device can be mounted on a vertical surface. In this embodiment, the mounting can be on a wall, a post or on a frame system that allows for height (vertical) adjustment or lateral adjustment and/or combinations of such adjustment to suit the height of the person using the equipment and/or the standing position on a floor or platform of the user, as well as the part of the body engaging member being exercised. Such adjustments can also accommodate persons in wheelchairs, sitting, standing, lying down on side or back. The apparatus can be mounted vertically, horizontally, or on any angle to a firm object such as hospital beds, home beds, wheelchairs and home furniture or structures. The mechanism can be mounted to the surface with a quick-disconnect feature.

In the above description and as further described below, the flexure joint device provides a great advantage in allowing for exercise motion in any direction, including performing rotational actions, side to front, front to side, up and down, inward, etc. For example, the apparatus could incorporate both linear and flexure joint movement to simulate human movement. This would help with occupational therapy such as lifting a box over your head.

Such adjustable means are known in the art. For example, the flexure joint device and its lever arm can moved along a track and tightened when moved to a desired location or located with a quick-release pin type system where pins are inserted in apertures or friction lock tubing. It is preferred that the equipment's flexure joint device be designed such that a user can adjust the resistance of the apparatus by adjusting the pressure. A gauge can be provided and connected to the pressurizing lines, with a user friendly interface indicating levels of resistance as is the case with many aerobic exercise machines today. The gauge can be located so to be in plain view of the user. The resistance adjustment controls should also be located so as to be readily adjusted by the user of the equipment. The levels can be visualized digitally or by a needle scale type of arrangement. User interface can include a computer interface so a physical therapist or other attendant, for example, can control the workout program. For example, air springs could have pressure transducers, electronic pressure regulator, rotational flexure transducers, gyroscopes and accelerometers to interface with a computer. This would allow real-time monitoring of the air spring pressure, deflection direction, amount of deflection, velocity and acceleration which can determine several performance values. Amount of force exerted on the apparatus could also be determined by the air spring pressure differential produced when the air spring deflects and compresses the air. Mechanical stops could be used to limit the travel of the flexure member so that the patient's range of motion would be controlled so as not to re-injure or aggravate an injury. A computer rehabilitation program could be used by the physical therapist or other attendant to monitor and/or modify the characteristics of the flexure member.

The exercise device can have a bicycle type pedal mounted on the lever arm. In this embodiment, the lever arm can be resistance adjusted through the flexure joint device and the pedals can also have means for adjusting the peddling resistance. In this embodiment, the present invention becomes two exercising devices for exercising both arms and/or both legs. Seating means are provided either independent of the invention so the bicycle embodiment can be used or the bottom of the flexure joint device can be mounted on a surface common to the mounting of the seat means. Effectively, the user sits on a bicycle-like seat and is able to exercise by peddling while at the same time moving the arm with typically two hand grips inward and outward. Of course, the individual features can be used separately. That is, the legs can be exercised by the peddling action and the arms can be exercised by the flexure of the flexure joint device, combination or individually. In addition, in the bicycle-like seat embodiment or when a person is in a wheelchair, the person can pull up and lift his body of the seat/chair using the flexure apparatus, lean forward, left and right, against the flexure apparatus, and push and pull on the apparatus for exercising.

In another embodiment, legs and hips could be exercised by a stair stepping action provided by the invention.

In another embodiment, the person would be on a seat attached to a large lever arm and the air spring secured to the floor so legs and hips could be exercised by a seesaw motion.

In another embodiment, the T-bar or generally T-shaped hand grips can themselves be adapted to include a flexure joint device. In this case the rigid frame member may be a relative long frame member extending from a wall or floor or it may be a very short base member attached to a table top surface or the like or the wall. This embodiment is great for exercising the shoulders, forearms, wrists and hands.

Another embodiment is the use of two side by side flexure joint devices, each having on its top a generally planar and elongate foot standing surface that extends a pre-determined lever arm distance (for example, 12 to 24 inches away from the flexure joint device), and each generally parallel to each other. A person can stand on each lever arm and use the apparatus as a step exerciser. It is preferable if handrails for balance be available to the user.

The combination can have a foot positioning surface for exercise of the feet and legs and to ensure that a person's foot does not slide off the surface. These surface forms are typical of stair stepping exercise equipment used in gyms.

In other embodiments, the flexure apparatus can be configured so that the bottom of an air spring is mounted to the floor or stationary base and a small platform is mounted to the top of the air spring. This would be used to help with balancing and will strengthen hip flexors. Air pressure would be regulated so that higher air pressure stiffens the platform and limits range-of-motion and the opposite for lower air pressures. A safety hand rail should preferably be built around the balancing plate.

Further, specific flexure devices can be configured for activities such as: arm wrestling, strengthening baseball and football throwing arms, strengthening muscles around all joints, recovery from operations such as knee or elbow surgery, tendonitis, tennis elbow, and similar conditions.

In optional embodiments, the human interface device or lever arm of such human interface device can be made to be interchangeable using means for performing that function that include several methods known in the art, such as threaded coupling, overlapping lever arms with a pin or ball snapping into a mating aperture like patio umbrella poles or hitch type pull pins, and the like.

Another option that can be integrated in the invention is the inclusion of means for hand pumping air pressure using a hand pump air cylinder that is incorporated with or integrated into the lever arm portion of the device. That is, the equipment is configured for use as a dual purpose hand pump air source for the lever arm and the human interface device or handle. The hand pump functions similar to a bicycle pump and strong enough to function as a lever arm.

DETAILED DESCRIPTION OF THE INVENTION

Figure 1:
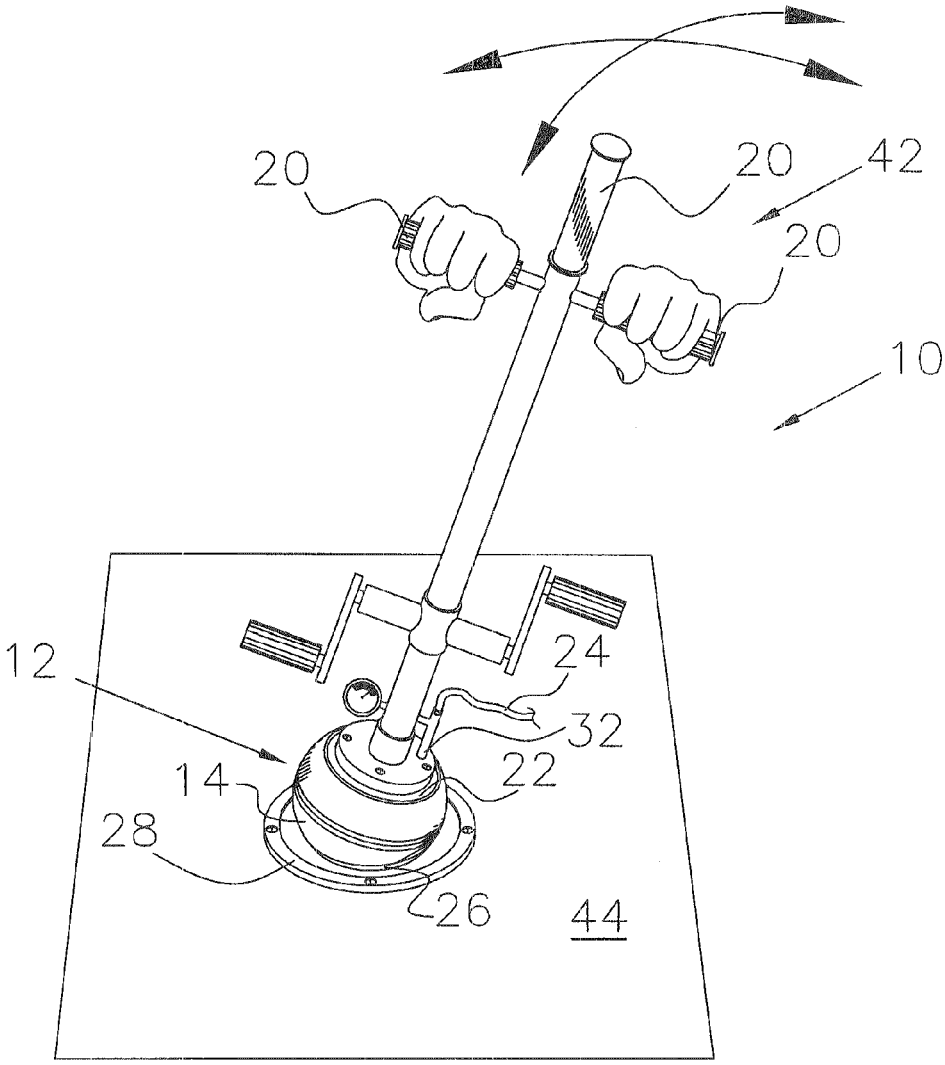
FIG. 1 is a perspective conceptual view of one embodiment of the present invention with the lever arm in use.
Figure 2:
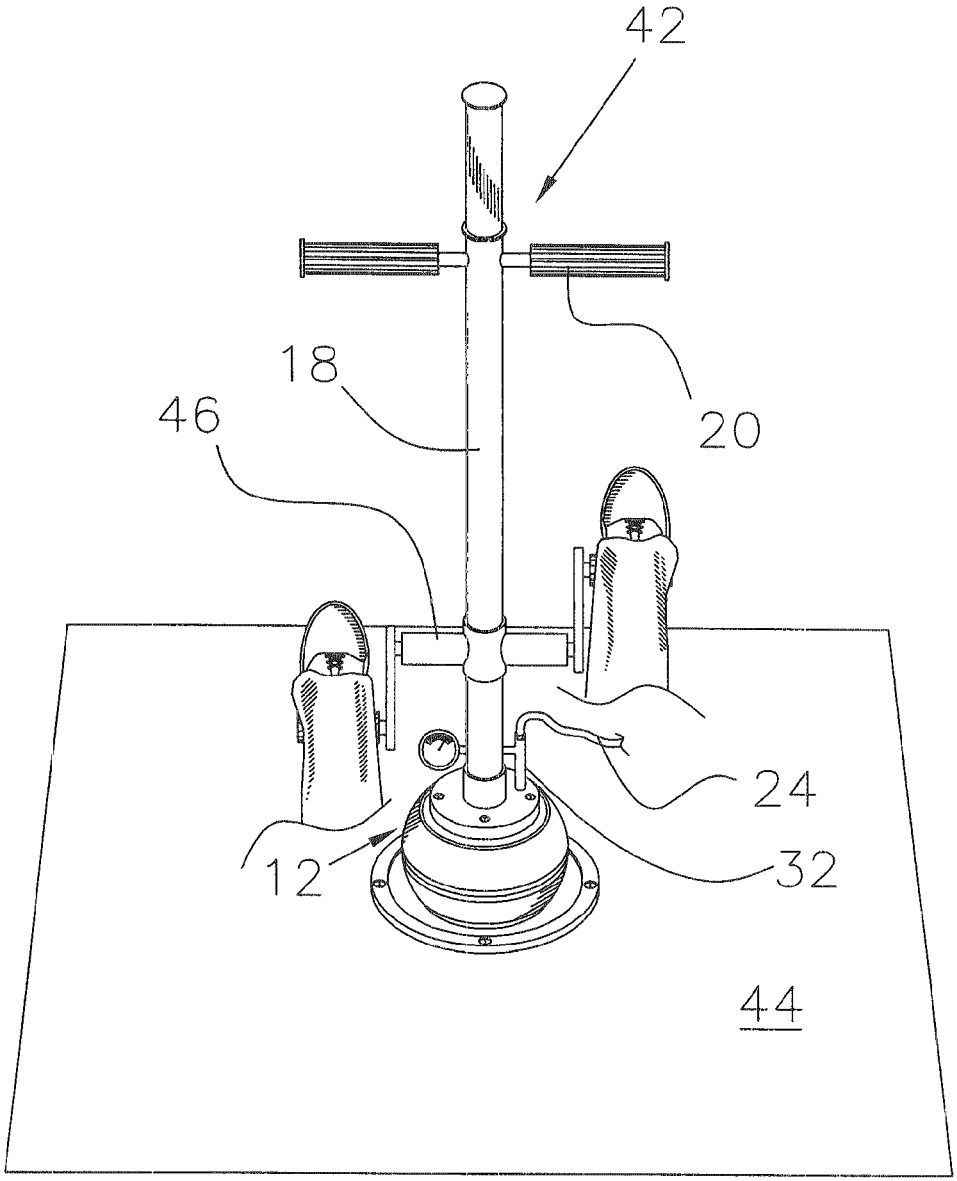
FIG. 2 is a conceptual depiction of the embodiment of FIG. 1 with a peddle assembly being used.

Turning now to FIGS. 1-18, one or more embodiments of the invention 10 are generally depicted. There is shown a flexure joint assembly 12 (also referred to herein by its industrial generic name as an air spring or air spring assembly), having an inflatable bellows or bladder 14, filled with a fluid 16 such as air or hydraulic fluid. To the upper part of the assembly 12, is attached a lever arm 18 having a hand grip 20. The lever arm 18 alone or the lever arm 18 in combination with a hand grip or manipulative handle of some desired configuration, like a handle bar, a cross-shaped member, a hand grip, a generally T-shaped member, or a round knob-shaped ball like a Q-ball all serve as human interface members. The lever arm 18 is attached to the assembly's 12 upper plate 22, which covers the bellows 14. Pressure is introduced into bellows 14 via conduit means 24 for supplying the fluid 16 to and for pressurizing the flexure joint assembly 12.

The lower portion or plate 26 of the flexure joint assembly 12 is attached to a rigid unsprung base member 28. By "unsprung" is meant that the air spring assembly 12 does not impart any springing action to base member 28. Base member 28 merely holds air spring assembly in place when lever arm 18 is moved to exercise a user. The base member 28 attached to the flexure joint assembly 12 can be mounted on a vertical surface 30. In this embodiment, the mounting can be on a wall 30*a* or on a frame system 30*b* (examples only) or other working/anchoring member, including a post, that allows for height (vertical) adjustment or lateral adjustment and/or combinations of such adjustment to suit the height of the person using the equipment and/or the standing position on a floor or platform of the user, as well as the part of the body engaging member being exercised. Of course, frame system 30*b* could be independent or itself mounted to a wall surface 30*a* or other working/anchoring member.

The flexure joint assembly 12 has a fluid inlet port 32, which is in fluid communication with the bellows 14, the conduit means and a fluid supply source 34, which typically an air compressor system or a hydraulic pump system.

Figure 3:
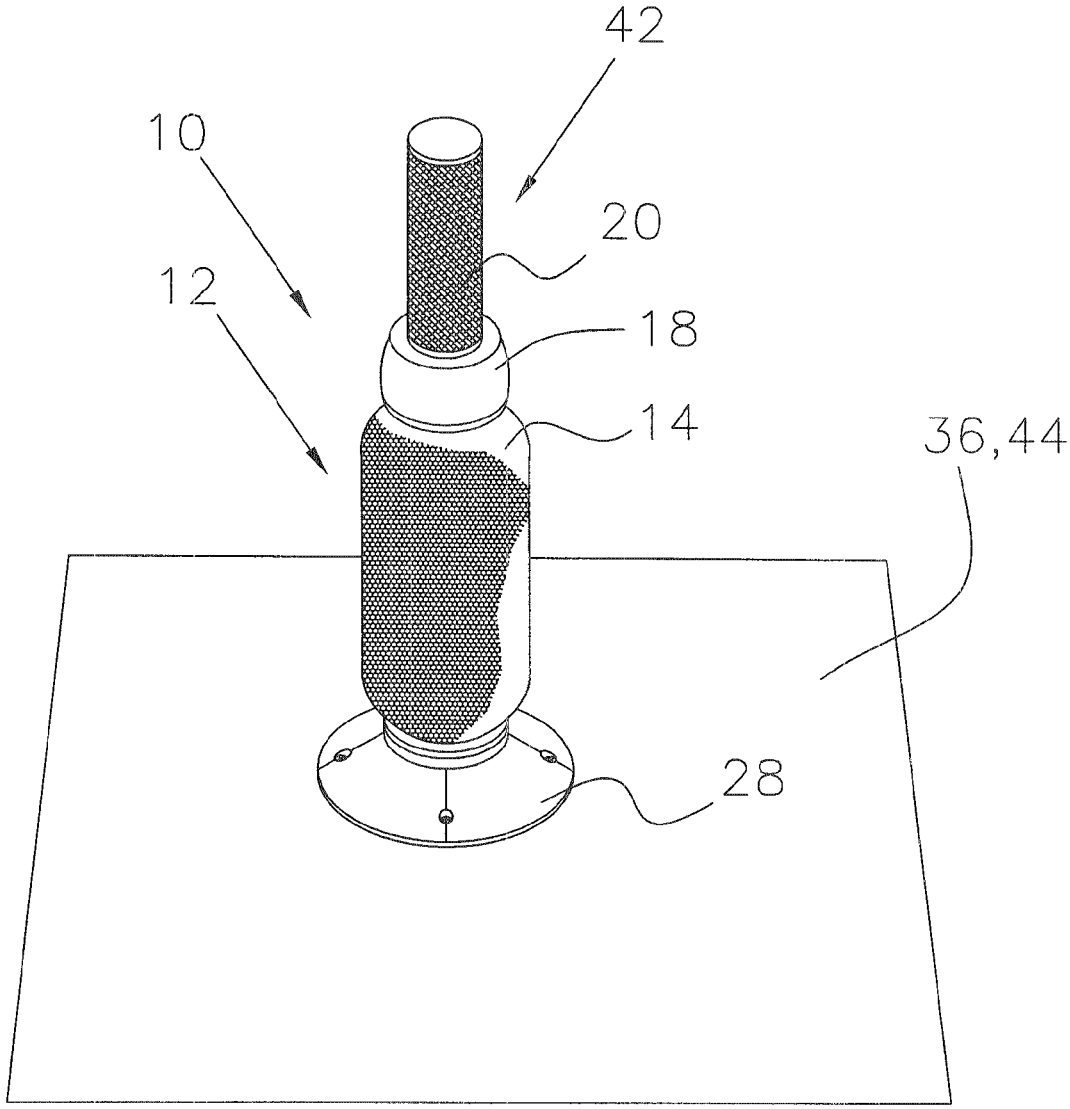
FIG. 3 is a conceptual depiction of another embodiment of the invention where the lever arm is relatively short for exercise of wrist and forearms.
Figure 4:
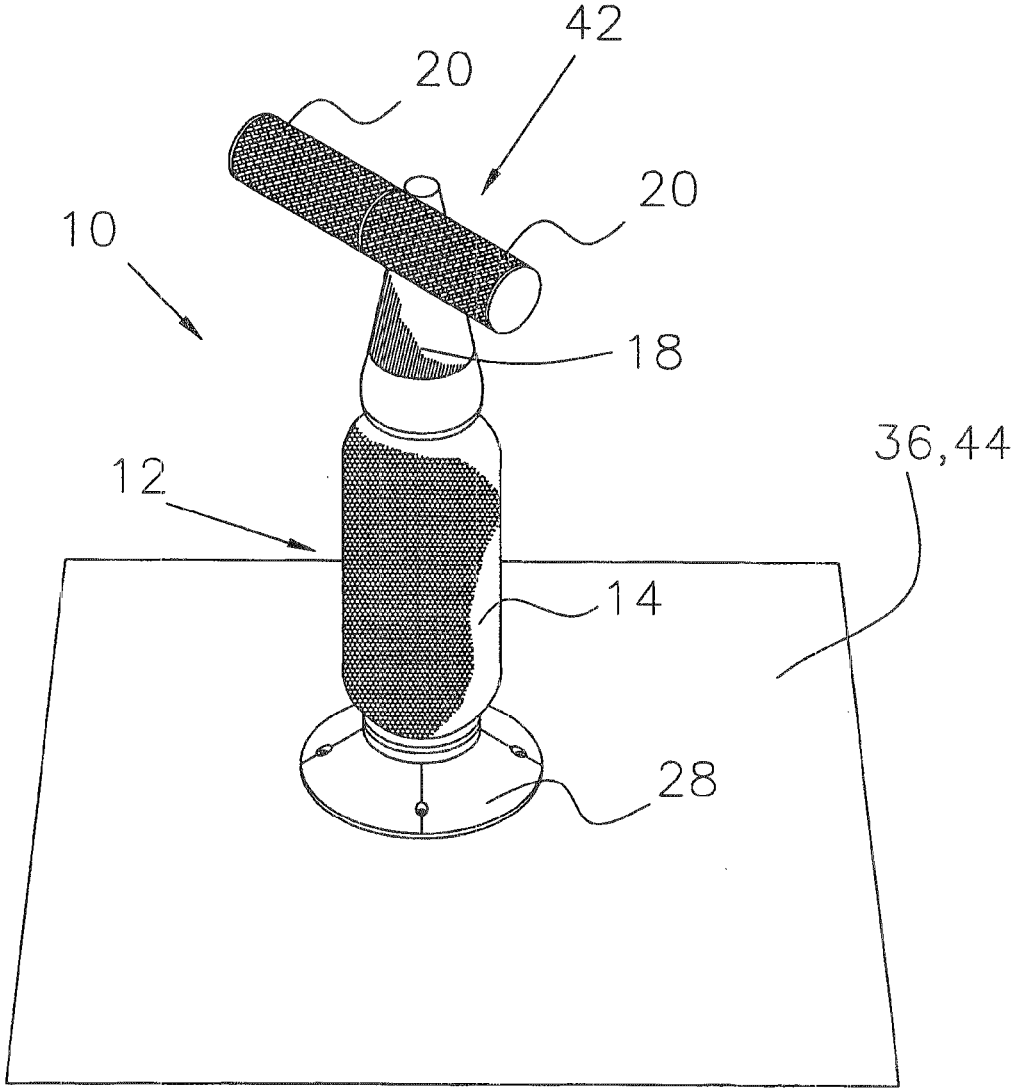
FIG. 4 is a conceptual depiction of an embodiment similar to that of FIG. 3, except that a T-shaped handle is provided for gripping by both hands.
Figure 5:
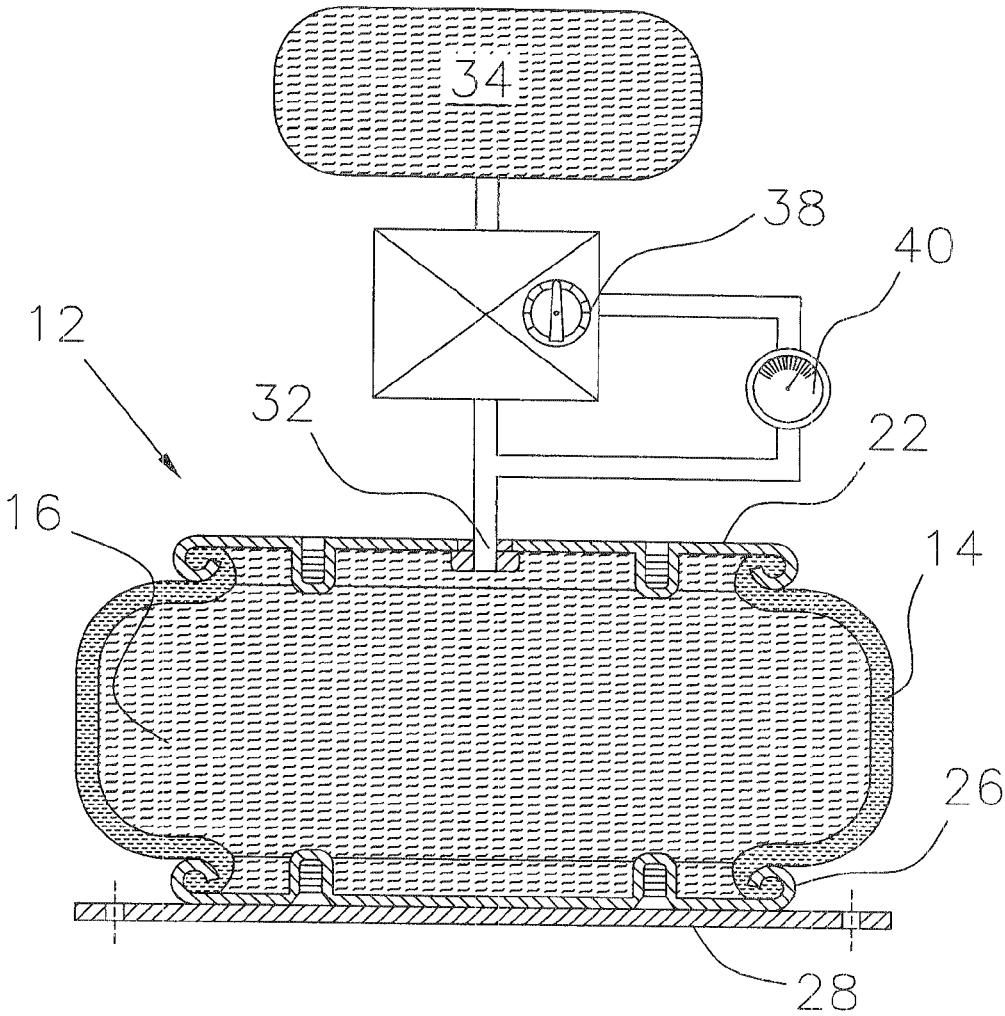
FIG. 5 is a conceptual partial cross-section depiction of a bellows system where the fluid medium is hydraulic fluid filled from a hydraulic pump source.
Figure 6:
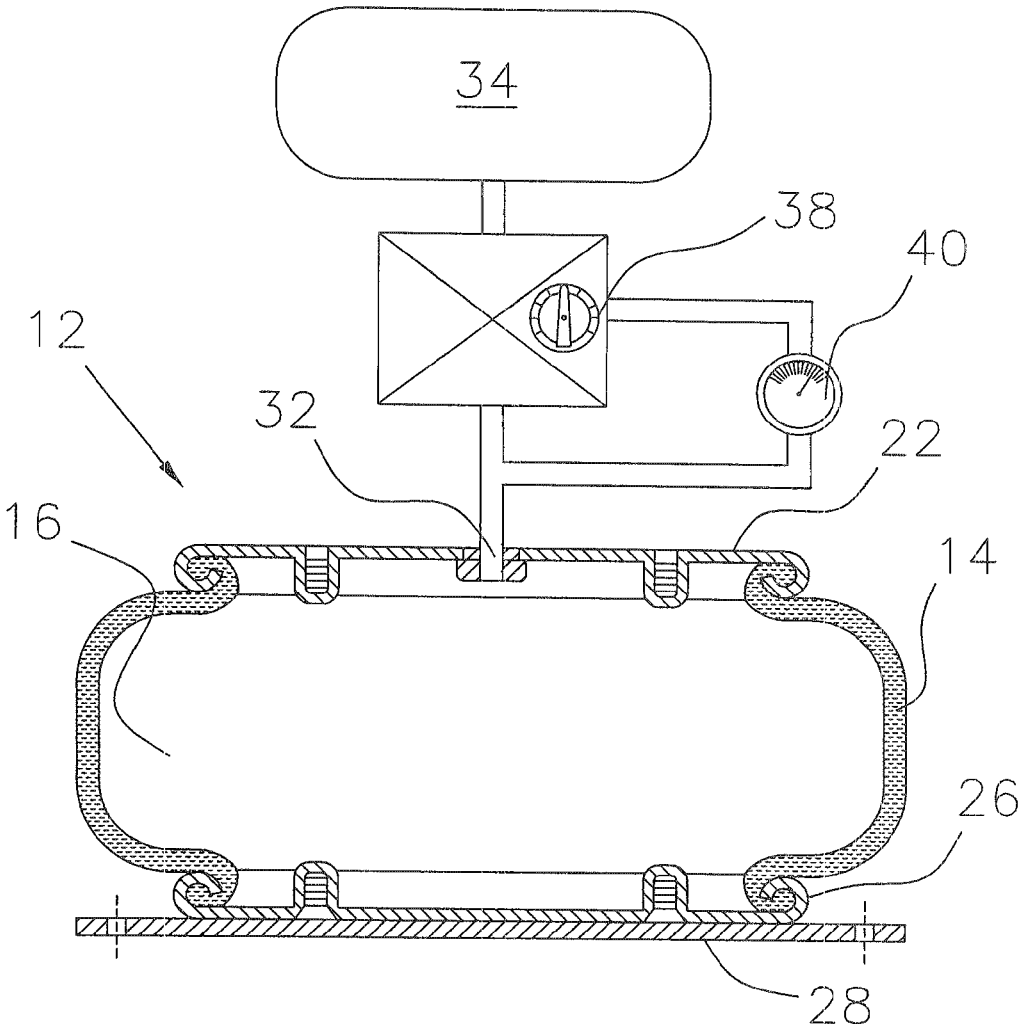
FIG. 6 is a conceptual partial cross-section depiction of a bellows system where the fluid medium is air filled from an air compressor source.
Figure 7:
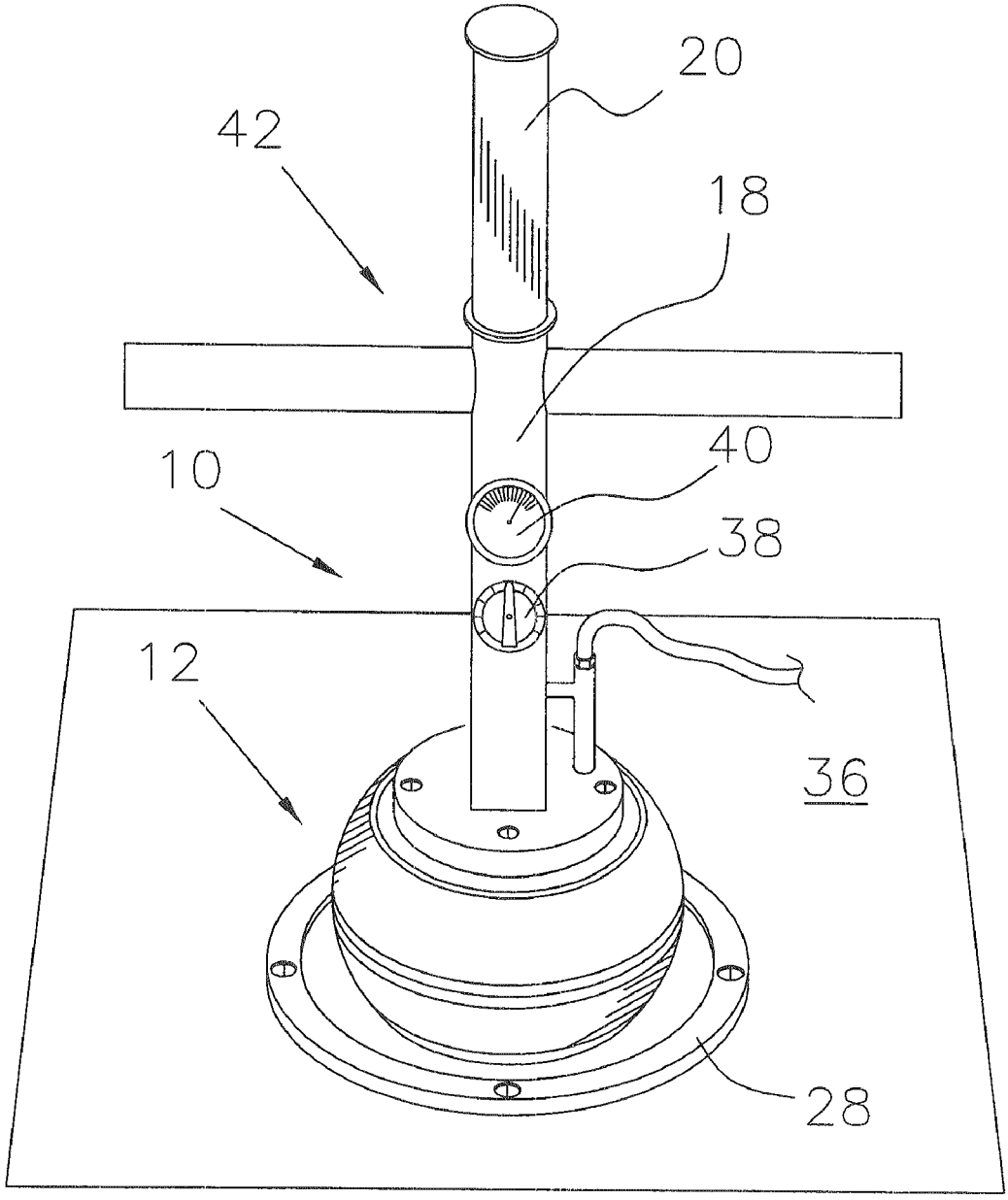
FIG. 7 is a conceptual depiction of an embodiment similar to FIG. 1, except the lever arm is shorter and the invention is mounted on a table or elevated surface.
Figure 8:
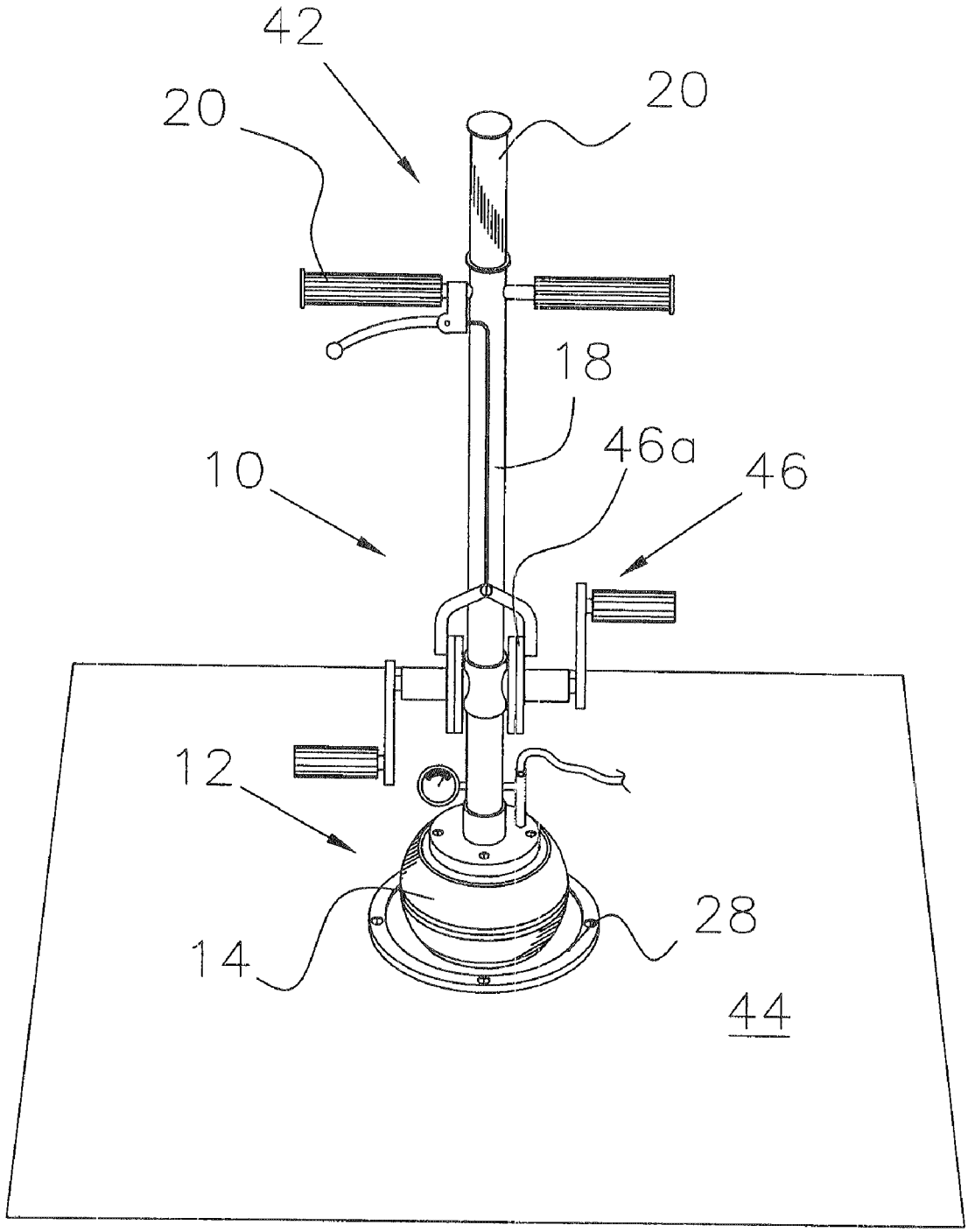
FIG. 8 is a conceptual depiction of an embodiment similar to FIG. 1, further depicting an example of how resistance can be applied to the peddling action.
Figure 9A:
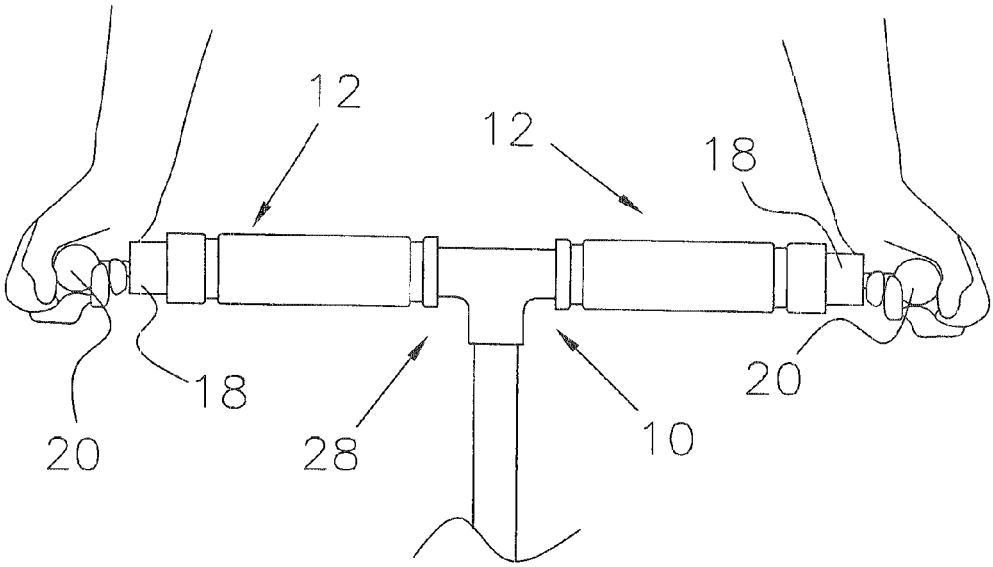
FIGS. 9*a* and 9*b* are conceptual depiction of the invention where the rigid member to which the flexure joint assembly is attached is a T-shaped structural member to facilitate exercising with both hands at the same time.
Figure 9B:
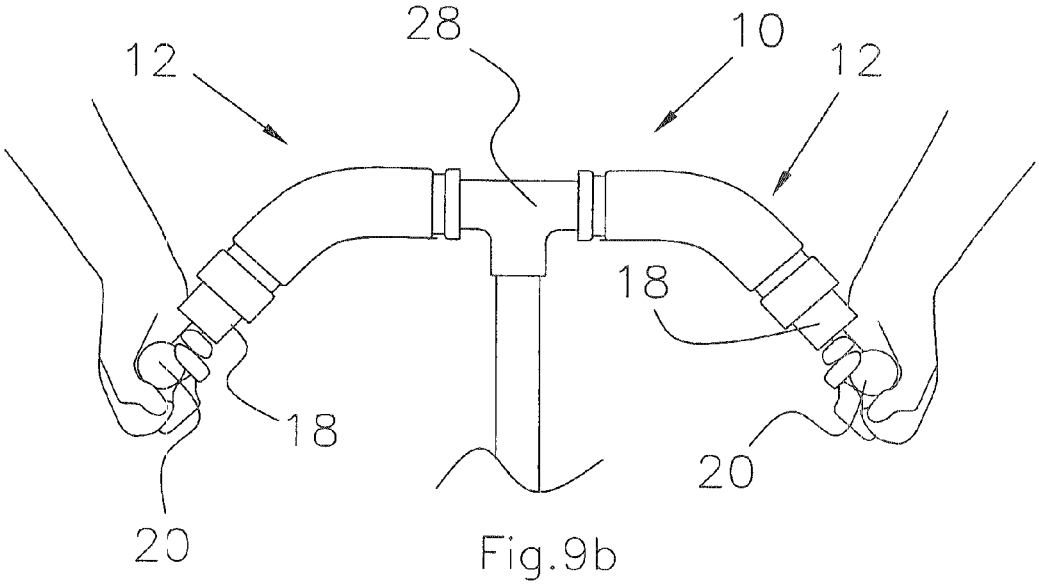
Figure 10:
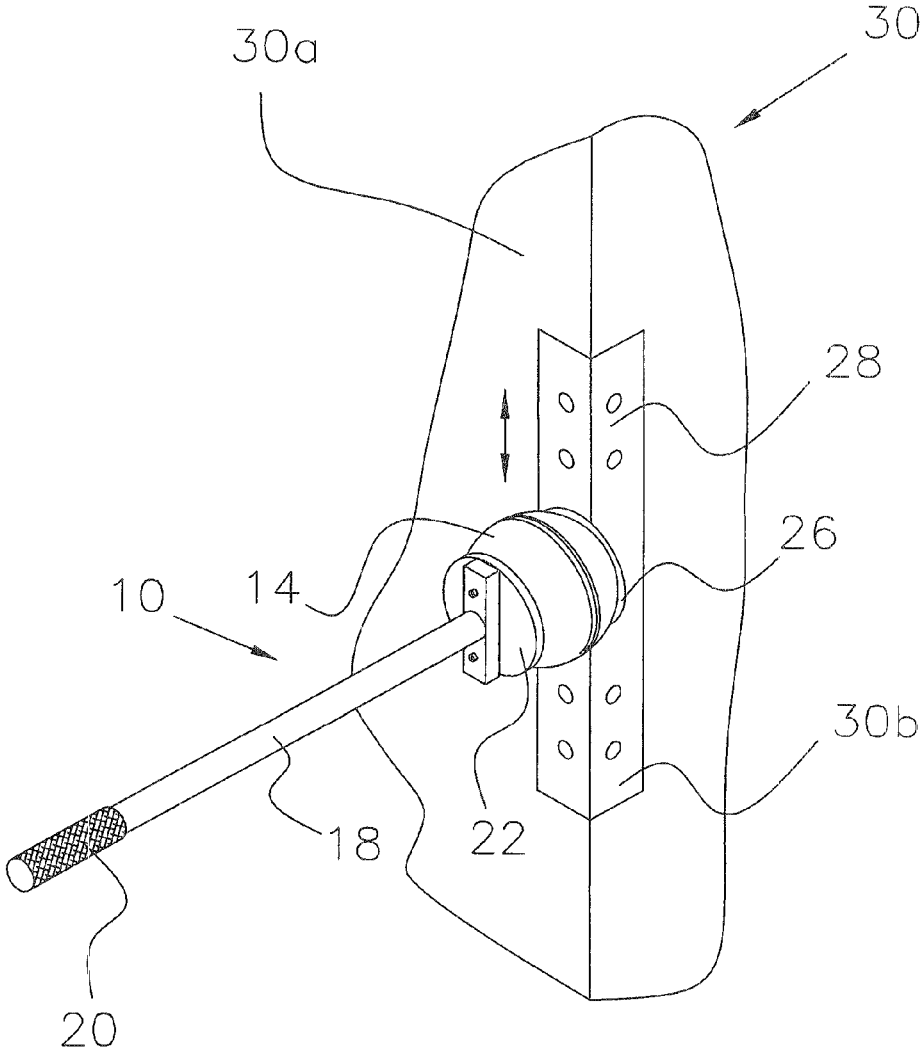
FIG. 10 is a conceptual depiction of an example of mounting the invention on a wall surface with elevation adjustment possibilities.
Figure 11:
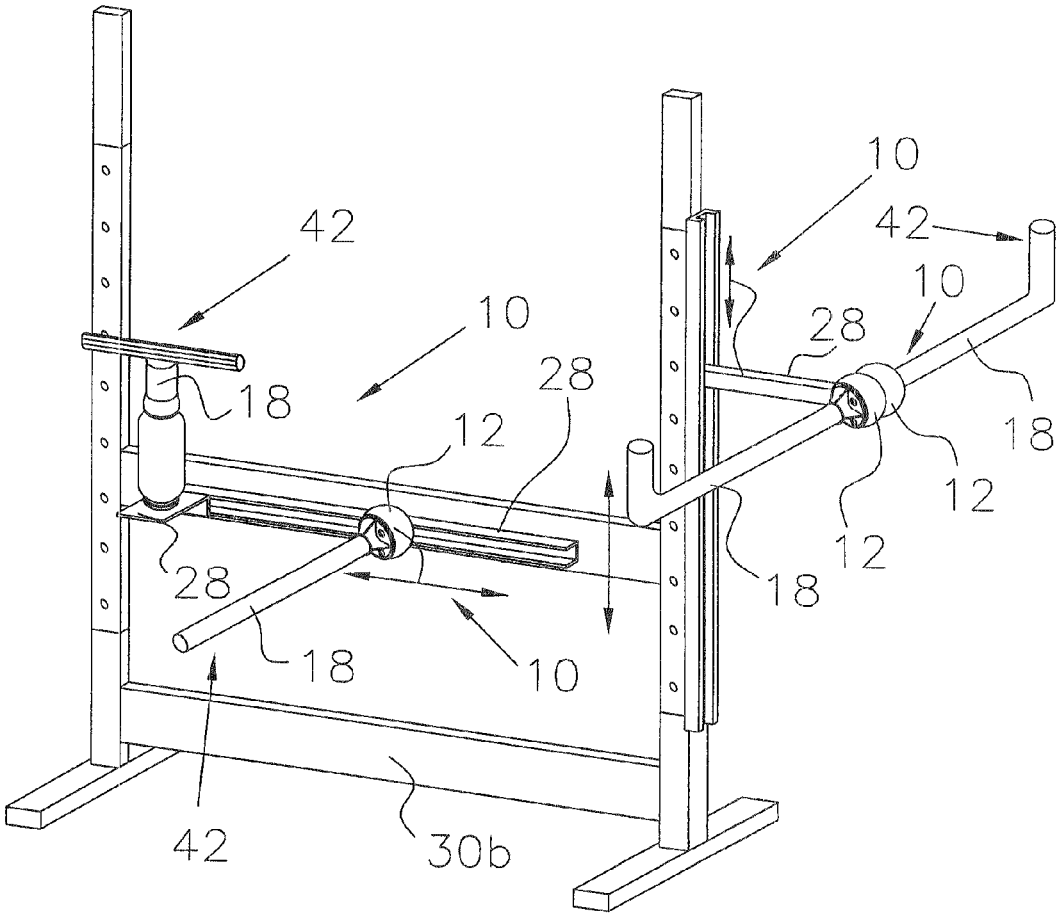
FIG. 11 is a conceptual depiction of various embodiments of the invention being applied to a universal gym type frame system.

FIGS. 3, 4 and 7 depict examples where the invention 10 is shown on an elevated surface or table surface 36. Means for regulating the pressure to adjust resistance is conceptually depicted as 38 in FIGS. 5 and 6. Conceptually, the means 38 for regulating the pressure is a control device that can be located so as to be used by an attendant, such as a therapist, either adjacent to the invention or remotely from an attendant working station. This includes setting up means 38 to be computer controlled. This conceptual regulating means applies to all embodiments shown in all the drawings, although not shown in FIGS. 3 and 4 and only partially shown in FIG. 7. The amount of pressure, which should be presented on the gauge face in user friendly terms such as resistance levels 1-10, is shown conceptually as gauge 40. Of course, the gauge face could also be presented in an actual pounds per square inch (psi), foot-pounds, or a similar analogous scale that imparts some meaning to the person using the equipment according to the embodiments of the invention, depending on the preference of the manufacture and the intended use of the invention. The levels can be visualized digitally or by a needle scale type of arrangement.

Handle means 42 at the upper end of the lever arm 18 are provided. The handle means 42 can provide for different types of hand grips 20. Typically hand grips 20 can be designed to be integral to the lever arm 18, or designed to cover a portion of the lever arm 18 such as a rubber or foam base hand grip. The lever arm's 18 opposite end is attached to flexure joint assembly 12, which in turn is mounted on table surface 36.

When mounted to a frame system 30*b*, the air spring assembly 12 and the frame system 30*b* (as well as the wall surface 30*a*) can be adapted so that assembly 12 is engaged to allow vertical and/or horizontal movement to suit the height or position of the user. This can be done by a number of ways known in the art, including the use of a track or channel with position tightening means such as bolts or quick release pins through mating apertures in the assembly lower portion 26 and the frame system 30*b* or even the wall surface 30*a*. Of course, another alternative is to have the bolts or release pins or other tightening means engage a channel in the wall or frame system under pressure. This allows the invention 10 to be moved up and down on a vertical wall surface 30, thereby allowing the height of lever arm 18 to be adjusted by the user.

The air spring assembly or flexure joint assembly 12 can be mounted or attached on a floor or other planar or generally horizontal platform 44. In an embodiment from the basic invention 10, a peddle assembly 46 is added to lever arm 18 to provide for exercise of the legs while exercising the arms with handle means 42 at the upper end of the lever arm 18. The resistance of pedal assembly 46 can also be adjustable using means known in the art, such as by using tension friction belt-type of systems as often used with exercise bikes or by using tubing with a smooth bore and a friction (phenolic) block inserted around the peddle shaft with an air inlet for pressurizing the back side of the block to obtain the desired resistance, or by using disc pads 46*a* with adjustable friction faces.

Various air spring assemblies can be employed in the practice of the present invention. Various lengths are available, as are assemblies having one or more convolutions. The style used will typically be a matter of design choice and aesthetic. For example, a more tubular or cylindrical shaped bellows may be desirable for the hand/wrist exercise embodiment, such as the bellows 14 shown in FIGS. 3, 4, 9*a* and 9*b*.

Figure 12:
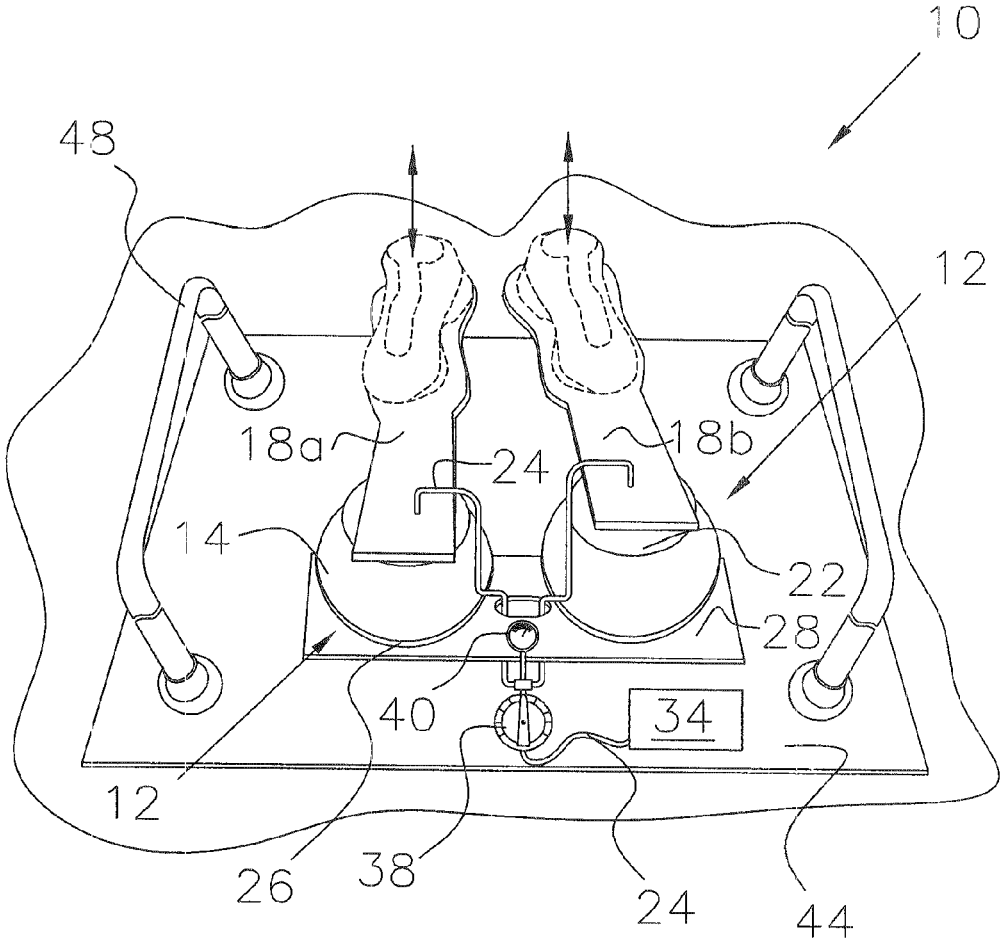
FIG. 12 is a conceptual depiction of another embodiment of the invention where two flexure joint assemblies are used with parallel lever arms adapted to support the feet of the person exercising with a common resistance regulating system and fluid source so that the invention can be used as a stair stepping exercise machine.

In another embodiment depicted in FIG. 12, two parallel air spring assemblies 12 are attached to a floor or horizontal platform 44. Generally flat lever arm 18*a*,18*b*, each attached to one of the two air spring assemblies 12, extend relatively parallel to the plane of the floor a pre-determined distance from the flexure joint assembly 12. Typically, the lever arms 18*a*,18*b* will be about 12 to 18 inches, but can be more or less. The user can exercise his or her feet and legs by moving them up and down while standing on lever arms 18*a*, 18*b* and using the embodiment as a stair stepper. A support frame for maintaining balance 48 should be used in conjunction with this embodiment of the invention 10, so that a user has something to hold on to while exercising.

Figure 13:
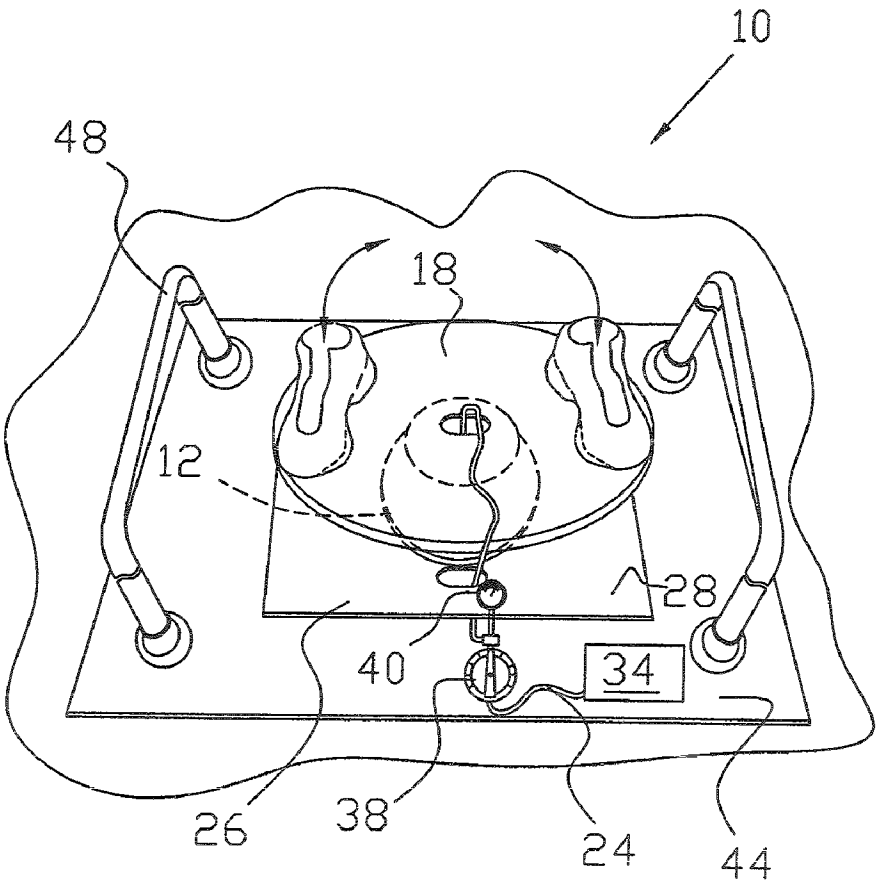
FIG. 13 is a conceptual depiction of another embodiment of the invention configured to be used as a balance exercise machine.

In another embodiment similar to that depicted in FIG. 12, FIG. 13 depicts a single air spring assembly 12, which is attached to a floor or platform 44 and the lever arm 18 is configured to serve as a human body engaging member so that a person exercising to enhance his or her balance can stand on the platform/lever arm portion. That is, the human body engaging or human interface member is in an overlying relationship to the closed upper portion of the flexure joint assembly and is configured so that a person exercising can stand on said human body engaging member for performing a balance exercise.

It should be understood that in the above mentioned embodiments, a vacuum cup with a 12 VDC portable air and vacuum compressor may be utilized.

Figure 14:
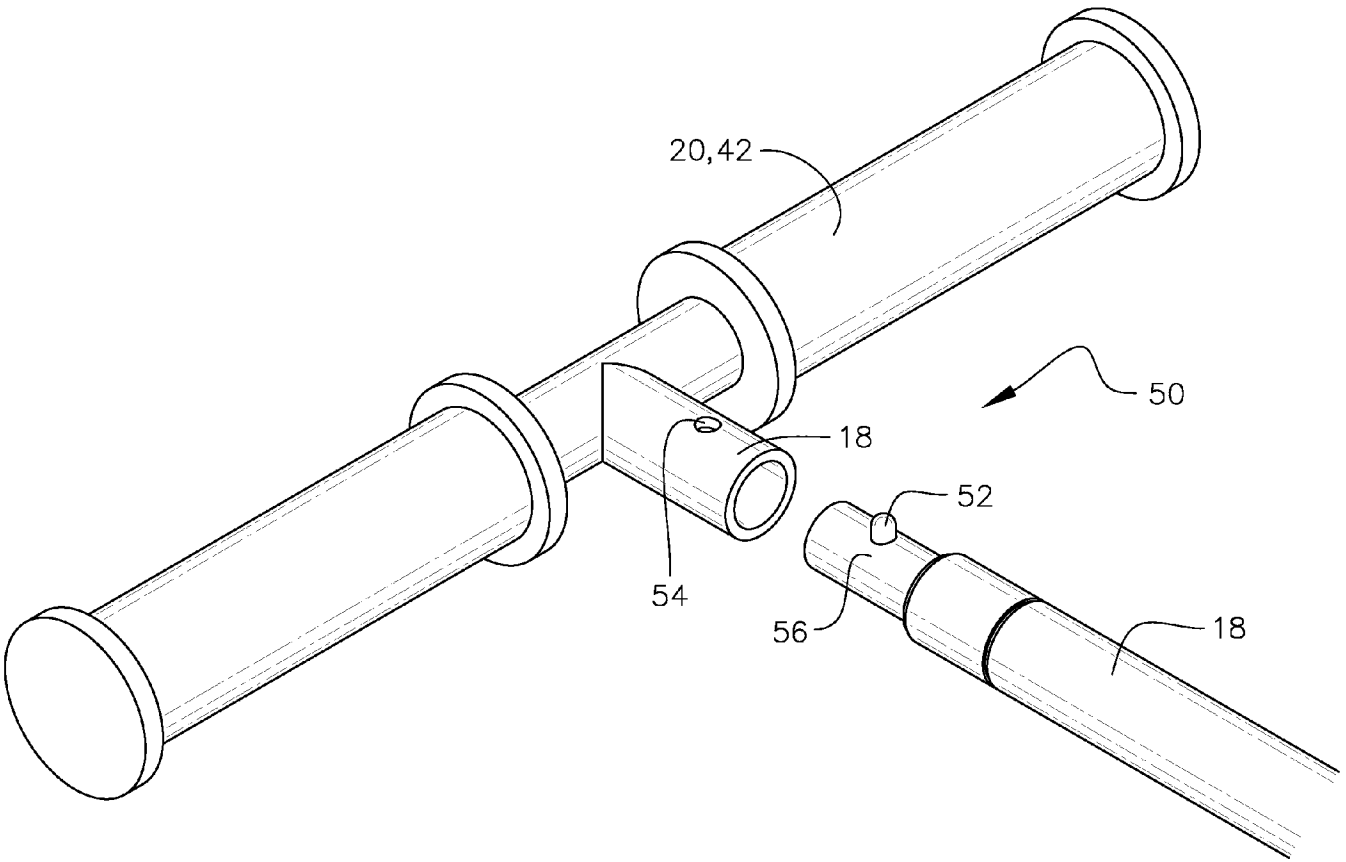
FIG. 14 is a representative conceptual depiction, using by way of example only a T-shaped handgrip, of one method to make the human interface portion interchangeable.

In alternative configurations contemplated by the present invention, FIG. 14 depicts a representative conceptual depiction, using by way of example only a T-shaped handgrip 20,42, of one method to make the human interface portion interchangeable the human interface device. Certainly, there are many more way of providing this feature. In the example depicted, human interface device 20,42 or lever arm 18 associated with such human interface device 20,42 can be made to be interchangeable using means 50 for performing that function that include several methods known in the art, such as threaded coupling, overlapping lever arm segments 18 with a pin or ball 52 snapping into a mating aperture 54 like patio umbrella poles or hitch type pull pins, and the like.

As shown in FIGS. 15-18, another option that can be integrated in the invention is the inclusion of means 60 for hand pumping air pressure using a hand pump air cylinder 76 that is incorporated with (such as attached to the side of lever arm 18—not shown) or integrated into the lever arm portion 18,76. That is, the equipment is configured for use as a dual purpose hand pump air source for the lever arm 18, and the human interface device or handle 20,42. The hand pump functions similar to a bicycle pump and strong enough to function as a lever arm.

Figure 15:
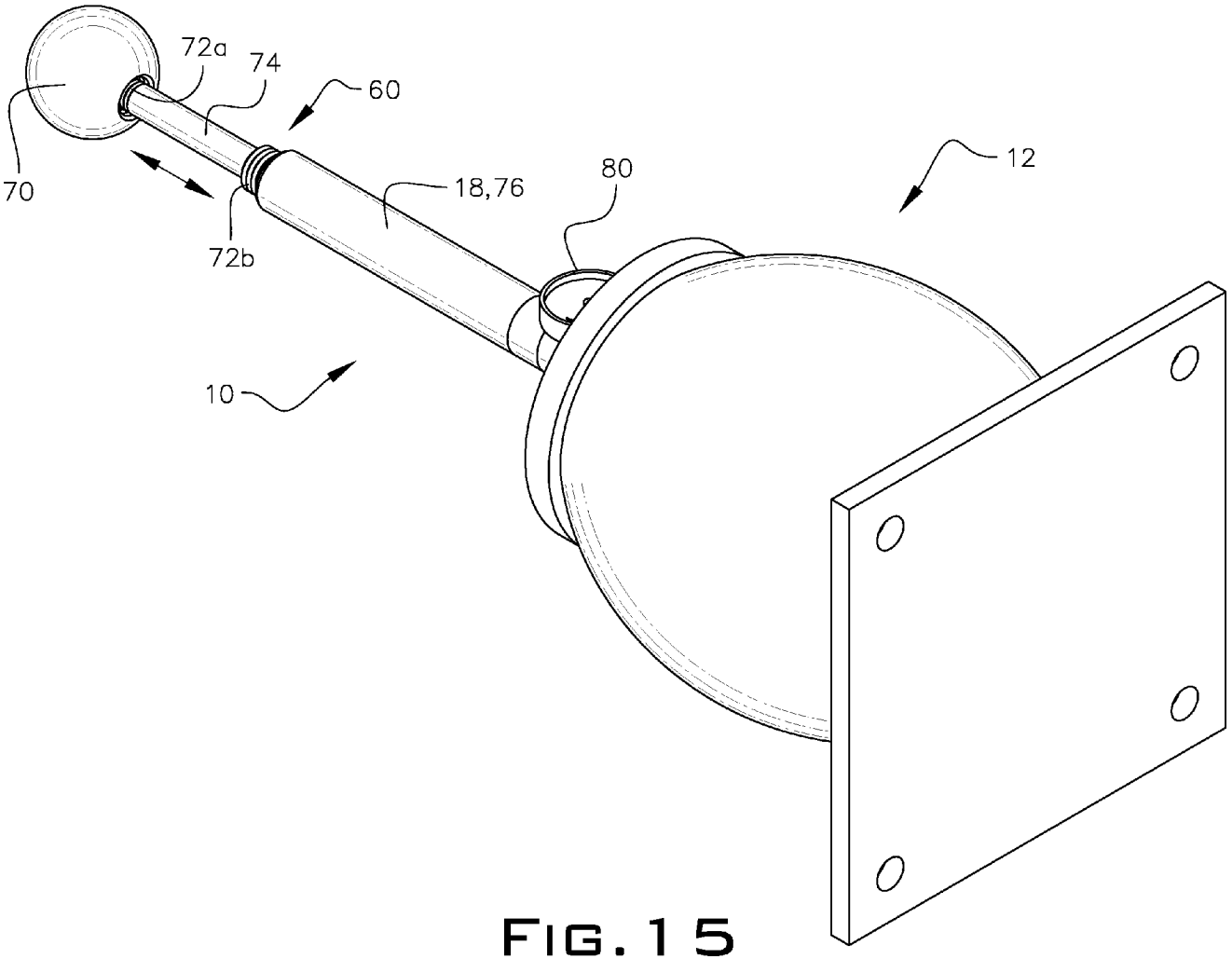
FIG. 15 is a representative conceptual depiction of another embodiment of the invention where the air spring is pressurized using a hand pump associated with the lever arm.

In the FIG. 15 depiction, the ergonomic human interface is like a Q-ball 70. This acts like the ball of a ball and socket joint with the operator's hand as the socket allowing the operator to easily move and rotate the lever arm 18,76 in various directions and arcs with limited wrist stress.

Figure 16:
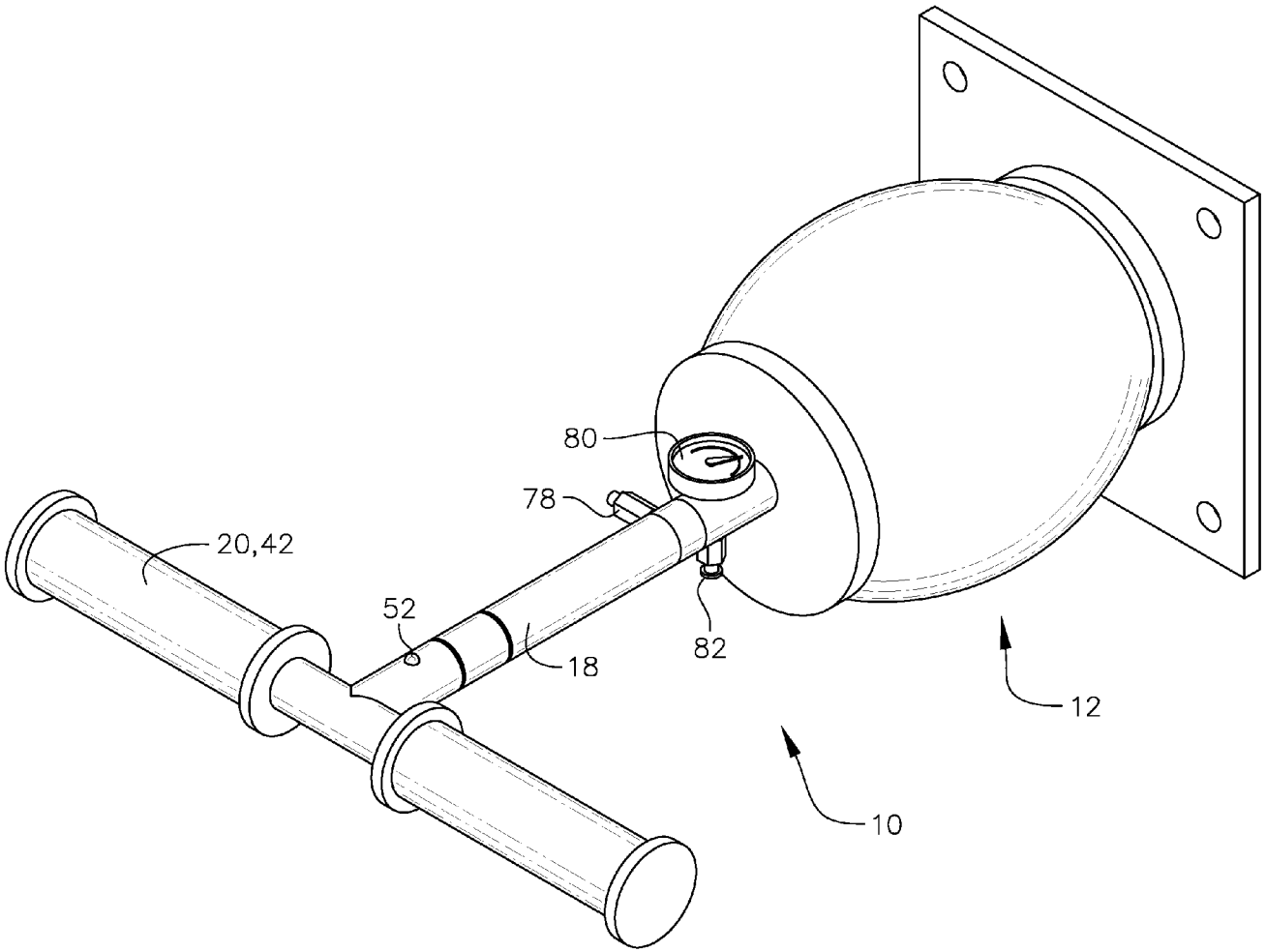
FIG. 16 is a representative conceptual depiction of an embodiment similar to FIG. 15 where the air spring is pressurized using a hand pump associated with the lever arm and means for providing interchangeability of the human interface member are optionally provided.
Figure 17:
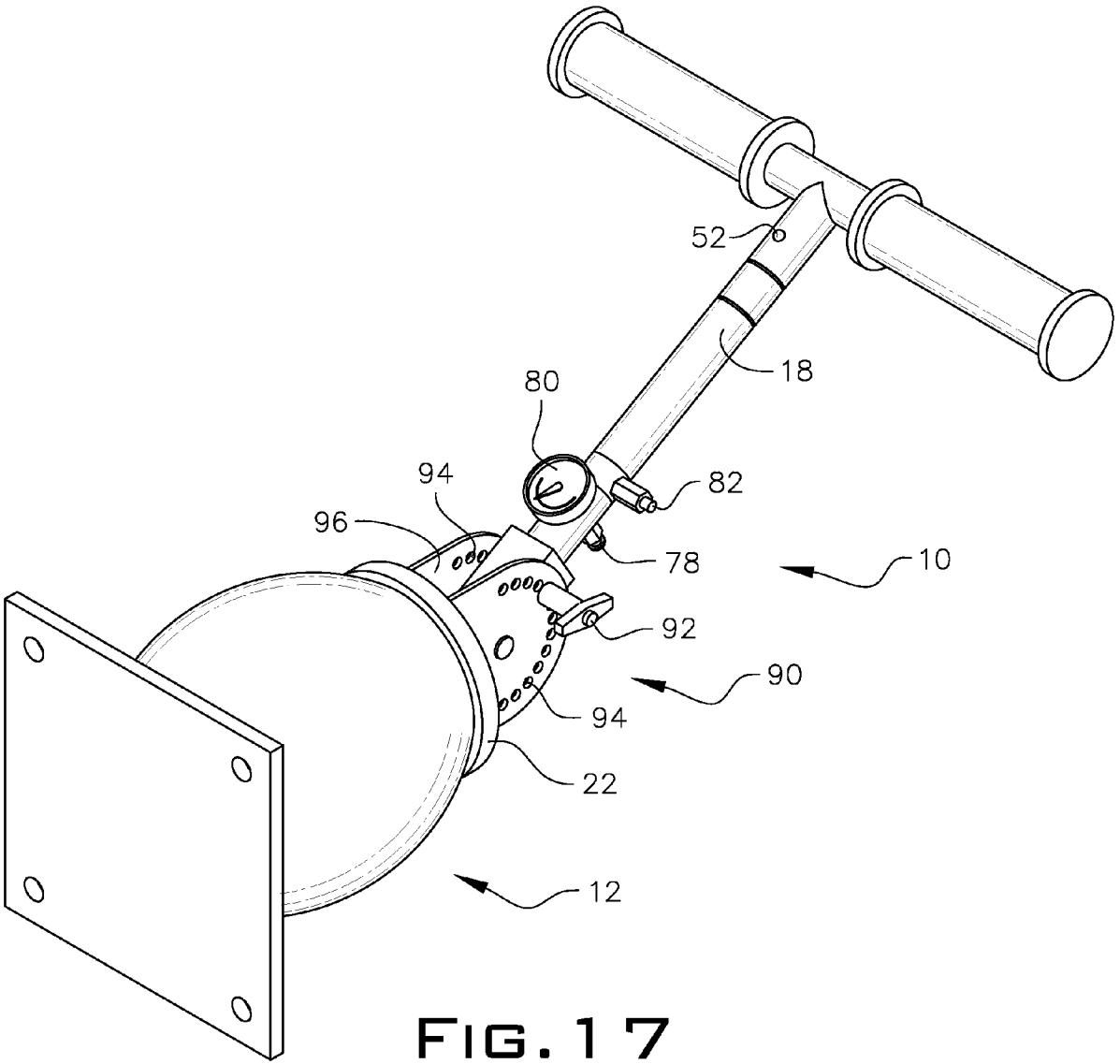
FIG. 17 is another conceptual embodiment of an embodiment similar to those depicted in FIGS. 15 and 16, with the additional inclusion of one example of providing an angular adjustment mechanism.

The Q-ball (or round knob-shaped ball) 70 is synonymous with and can be interchanged with a T-handle as in FIGS. 16 and 17, straight grip like a bicycle hand grip such as those depicted in FIGS. 1, 3, 4, 7, 8, 9*a*, 9*b*, 10, or 11, straps (not shown) or other ergonomic human interfaces. In the representative conceptual design depicted, the Q-ball 70 has two sets of threaded mating components: a smaller thread 72*a* to accept the small diameter piston rod 74 of the air cylinder 76 (which includes a housing that serves as the lever arm 18 described in previous embodiments) and this is secured so it cannot be accidentally unfastened and a larger thread 72*b* that attaches the Q-ball 70 to the head of the air cylinder 76. To use the equipment, unscrew the Q-ball 70, then pull it out to extend the piston rod 74 of the cylinder 76. This allows air to enter the void created in the cylinder housing through the Air Intake Check Valve 78. When the piston rod 74 is fully extended, then push it in. The Air Intake Check Valve 78 seals off and the compressed air enters the air spring assembly 12 and increases the existing air pressure with each pump or cycle of the Q-ball 70 and piston rod 74 assembly. Actual air spring pressure (resistance potential) can be observed or verified with the visual Pressure Gauge 80. To reduce air spring pressure and thus resistance, the Pressure Relief Valve 82 is depressed and released at the desired pressure. When operating pressures is achieved, then push in the Q-ball 70 and secure it by threading onto the end of the lever arm air cylinder 76.

Alternate methods to secure human interface 20,42 to the lever arm air cylinder 76 could include a pull-pin, hitchpin clip, quick release button or equivalent method known to those in the art.

Preferably, the Lever Arm 18 with integral air pump 76 has a male threaded base that is fastened to the female threaded upper bead plate 22 on the air spring 12.

The assembly can be mounted to any rigid surface on any angle as noted above. The assembly can also be mounted using vacuum pads as an attachment means.

The air spring 12 with the large female thread in the center can be used for a lever arm pump assembly 76 fastened directly to the air spring 12.

Figure 18:
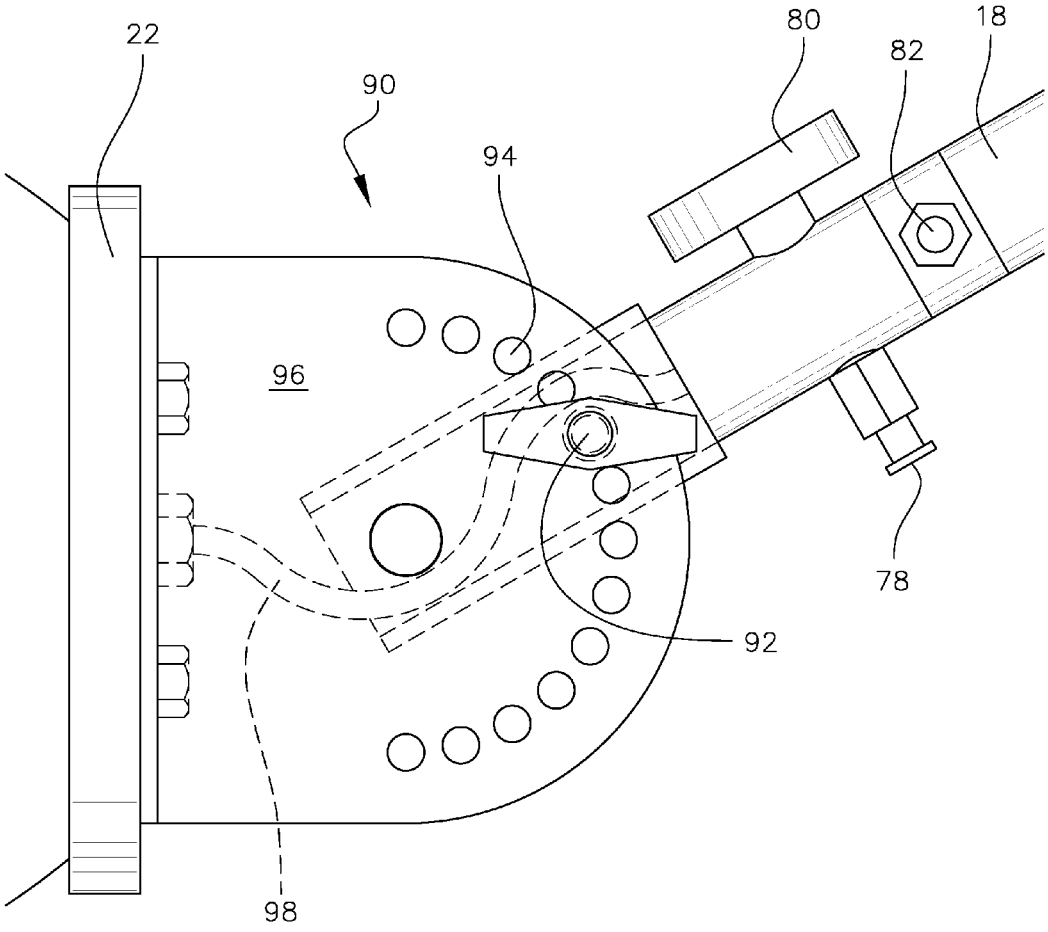
FIG. 18 is depiction of the angular adjustment mechanism of FIG. 17.

The conceptual embodiments depicted in FIGS. 16-18 can further be modified to include the interchangeability feature of the human interface member as discussed in other embodiments above by configuring the end of the lever arm 18 with a threaded adapter 56 (see FIG. 14 for depiction of adapter as adapter is not visible in depictions of FIGS. 16-17, except for exposed associated pin 52) that includes a quick-disconnect feature such as a pull-pin, quick release button 52 or equivalent method known to those in the art. In the embodiment depicted, adapter piece 56 can be a cylindrical threaded/push-button adapter 56, which is attached to the piston rod 74 with the same method as the Q-ball 70. Adapter 56 also attaches to the air pump cylinder 18 just like it does with the Q-ball. However, adapter 56 also has a quick release button 52 or equivalent that allows adapter 56 to exchange various engaging members 20,42.

The configurations depicting the integral hand pump can be scaled up or down as required for intended purposes. Straps (not shown) attached to the lever arm or handle attached to the lever arm can allow other parts of the body to be exercised or for people with weak grips.

In another alternative embodiment using the hand pump means 60, the invention can be configured to provide means 90 for making an angular adjustment of the lever arm 18 in relation to the closed upper plate portion 22 of the flexure joint assembly 12. This angular adjustment mechanism 90 allows the lever arm 18 to be pivoted to achieve a range of 180 degrees in selective adjustments. Locking the lever arm 18 at a desired angle can be made in a number of ways known in the art such as ball gripping positioning arms, however, one simple method is to have a pin 92 engage spaced-apart mating holes 94 in a bracket 96, which is fixed or otherwise attached to the upper closure plate 22. In this embodiment the lever arm 18 that includes the means 60,76 for hand pumping air in the flexure joint assembly 12 is actually separated from the closure plate 22. A hose 98 is connected from the bottom of the hand pump 60,76 to the air inlet of the flexure joint assembly 12 to allow for air or fluid communication between the hand pumping means 60 and the assembly 12. The lower end portion of the lever arm 18 is pivotally mounted to the bracket 96. Given that the lever arm 18 is not mounted directly to the closure plate 22, there are many other ways known to those skilled in the art to selectively position the lever arm 18 other than a pin/hole engagement type. The hole/pin engagement depiction is merely intended to provide for one simple example of providing this feature. To adjust the angles simply pull the pin 92, rotate the lever arm 18 to a desired angle and replace the pin 92.

A typical example of a combination of features can be incorporated, such as the Q-ball 70 and straight grip 20 on the same lever arm 18. The Q-ball 70 would release to pump air into the air spring 12. The straight grip 20 wouldn't move in this arrangement.

As mentioned above, in alternative configurations contemplated by the present invention, the human interface device or lever arm of such human interface device can be made to be interchangeable using means for performing that function that include several methods known in the art, such as threaded coupling, overlapping lever arms with a pin or ball snapping into a mating aperture like patio umbrella poles or hitch type pull pins, and the like.

It should also be noted that pressures for average exercises normally do not exceed 60 psi. Air springs can simply be scaled up for increased resistance at lower pressures.

It should also be understood that the preceding is merely a detailed description of one or more embodiments of this invention and that numerous changes to the disclosed embodiments can be made in accordance with the disclosure herein without departing from the spirit and scope of the invention. The preceding description, therefore, is not meant to limit the scope of the invention. Rather, the scope of the invention is to be determined only by the appended claims and their equivalents.

What is claimed is:

1. An exercise device comprising:

an adjustably resistive pivoting flexure joint assembly comprising at least one airspring assembly having at least one elastomeric bellows intermediate portion with a closed lower plate portion and a closed upper plate portion, both said closed lower plate portion and said closed upper plate portion being mechanically clamped directly to respective ends of said at least one elastomeric bellows intermediate portion, a lever arm having one end thereof attached directly to the closed upper plate portion of the flexure joint assembly, wherein said at least one elastomeric bellows intermediate portion serves as means for deflecting said lever arm at a variable resistance from a rest position to about 90° of deflection and rotating said lever arm at 360° of rotation, means for attaching said closed lower plate portion to a working/anchoring member or surface wherein said closed lower plate portion is configured to remain rigid and not move when said elastomeric bellows intermediate portion, closed upper plate portion and lever arm move, a human interface member removably connected to said lever arm;

wherein a combination of said human interface member, and said lever arm and said flexure joint assembly is configured to provide ergonomically resistive non-striking therapy for a desired body part; and said lever arm further comprising means for adjustably and selectively pressurizing the flexure joint assembly using hand pumping means for manually pumping air into said flexure joint assembly, said hand pumping means being integrated within said lever arm and connected to said human interface member, which facilitates said manual pumping of air; and wherein said flexure joint assembly when pressurized at a selected desired resistance is configured to maintain a stored energy level such that an applied force must be exerted by a person to displace said lever arm from a neutral position and said force must be maintained to resist said lever arm's movement back to said neutral position.

2. The exercise device according to claim 1, wherein said means for manually hand pumping air into said flexure joint assembly comprises a hand pump.

3. The exercise device according to claim 1, further comprising:

pressure regulating means for selecting a desired resistance to be applied to said person's desired body part for a selected pressure in said flexure joint assembly and for making adjustments to said resistance by adjusting said pressure in said flexure joint assembly, wherein said pressure regulating means is adjustable between 0-100 psig.

4. The exercise device according to claim 1, wherein said human interface member is a removable and interchangeable with another human interface member.

5. The exercise device according to claim 1, wherein said lever arm is annularly adjustable in relation to said closed upper plate portion of said flexure joint assembly, said adjustment having a range of 180 degrees.

* * * * *